US005797523A

United States Patent [19]

Gross

[11] Patent Number: 5,797,523

[45] Date of Patent: Aug. 25, 1998

[54] SNAP-ACTION CLOSURE WITH DISENGAGED COMPRESSION MEMBER WHEN LID IS CLOSED

[75] Inventor: Richard A. Gross, Oconomowoc, Wis.

[73] Assignee: Aptargroup, Inc., Crystal Lake, Ill.

[21] Appl. No.: 796,908

[22] Filed: Feb. 6, 1997

[51] Int. Cl.[6] ..... B65D 43/14

[52] U.S. Cl. ..... 222/498; 222/517; 222/556

[58] Field of Search ..... 220/334, 335, 220/337, 338, 339, 340; 222/498, 505, 517, 556

[56] References Cited

U.S. PATENT DOCUMENTS

| | | | |
|---|---|---|---|
| 3,850,350 | 11/1974 | Townes et al. | 222/556 |
| 4,172,540 | 10/1979 | Erichson | 222/517 |
| 4,371,095 | 2/1983 | Montgomery et al. | 222/517 X |
| 4,558,806 | 12/1985 | Shabram, Sr. et al. | 222/556 |
| 4,607,768 | 8/1986 | Taber et al. | 222/517 X |
| 4,901,892 | 2/1990 | Song | 222/498 |
| 4,911,337 | 3/1990 | Rosenthal | 222/517 |
| 4,969,574 | 11/1990 | Shastal . | |
| 5,273,177 | 12/1993 | Campbell | 222/517 X |
| 5,377,882 | 1/1995 | Pham et al. | 222/517 X |

FOREIGN PATENT DOCUMENTS

| | | | |
|---|---|---|---|
| 0 611 167 A1 | 8/1994 | European Pat. Off. | 222/498 |

OTHER PUBLICATIONS

Seaquist closures Drawing No. ABA-1160-B, revision dated Oct. 19, 1995 (1 sheet ) Sketch A of "Prior Art" (1 sheet).

*Primary Examiner*—Kenneth Bomberg

*Attorney, Agent, or Firm*—Rockey, Milamow & Katz, Ltd.

[57] ABSTRACT

A closure is provided for a container. The closure has a body for being mounted over the container opening and defines an orifice for communicating through the container opening with the container interior. The body also defines a pair of spaced-apart bearing cavities. A compression member has distal first end and a second end. The first end is adapted to engage a rear abutment wall of the body, and the second end is pivotally connected to the lid at a location spaced from the trunnion axis. Each bearing cavity has a clearance on opposite sides of the trunnion received therein when the lid is in the full closed position. The compression member length is such that the distal first end is spaced from the body rear abutment wall when the lid is in the full closed position.

15 Claims, 6 Drawing Sheets

SNAP-ACTION CLOSURE WITH DISENGAGED COMPRESSION MEMBER WHEN LID IS CLOSED

TECHNICAL FIELD

This invention relates to a closure for use on the open end of a container from which fluid contents can be dispensed.

BACKGROUND OF THE INVENTION AND TECHNICAL PROBLEMS POSED BY THE PRIOR ART

The U.S. Pat. No. 4,911,337 discloses a unitary, snap-action closure. The closure has a body which can be mounted to a container over the container opening and which defines a dispensing orifice for communication through the container opening with the container interior.

The body defines a pair of space-apart bearing cavities. A lid is provided with a pair of trunnions for each being received in one of the bearing cavities. The trunnions define an axis of rotation about which the lid can be pivoted through a range of movement between a fully closed position occluding the dispensing orifice and a fully opened position spaced away from the dispensing orifice.

A compression link member extends from the lid and has a first end connected to the closure body with a film hinge and has a second end connected to the lid with a film hinge. The second end film hinge is spaced from the trunnion axis. The compression link member is subjected to maximum stress when the lid is at an over-center point between the fully open and fully closed positions. When the lid is on either side of the over-center point, the lid is urged to a stable position at either end of the travel range in the fully closed position or the fully open position.

The bearing cavities in the closure body are configured and located on the closure body to provide a clearance at least on opposite sides of each trunnion when the lid and compression link member are in the fully open position and in the fully closed position.

In another conventional closure, similar to the above-described closure illustrated in the U.S. Pat. No. 4,911,337, the closure lid in compression member are molded as a unitary structure which is separate from the closure body. The distal end of the compression member is adapted to engage the closure body wall when the lid is in the fully closed position. Further, when the lid is in the closed position, the trunnions on the lid are moved forwardly to engage the front wall surfaces of the bearing cavities. Although it is desirable that the compression member be substantially free of compressive forces when the lid is closed, it is difficult to achieve such a condition owing to manufacturing tolerances.

While the above-described snap-action closures function generally satisfactorily in applications for which they have been designed, it would be desirable to provide an improved snap-action closure where the capability for maintaining the compression member free of compressive stress in the lid closed condition is less likely to be impaired owing to manufacturing tolerances.

Further, it would be desirable to provide an improved snap-action closure wherein the lid could be fully opened to an angle of 180° or more. If the lid can open 180° or more, the open lid can be more readily recessed within the top of the closure so as to provide a more aesthetically pleasing closure and so as to permit the package to be set on a support surface in an inverted orientation.

Lid opening angles of 180° or more can place severe compressive stress on the compression member. This can cause a more forceful snap action than is desired. This can also cause the compression member to fracture. Because of the larger forces imposed on the compression member when the lid is opened 180° or more, there is the possibility that when the lid is closed, there will be a substantial unrelieved compressive stress in the compression member.

Because a typical closure lid is generally open for only a small percentage of the closure life (as when the container contents are being dispensed), a closure lid and compression member must be capable of withstanding any residual compressive force in the closed position for long periods of time. However, when large residual compressive stresses exist in the compression member in the closed position, the compression member material may take on a permanent deformation or set and/or may fail when the lid is subsequently opened one or more times. Thus, it would be desirable to provide an improved snap-action closure in which the compression member is substantially free of compressive forces when the lid is fully closed. Such an improved structure should accommodate small manufacturing tolerances without imposing substantial compressive stress on the compression member when the lid is closed.

Further, it would be beneficial if such an improved snap-action closure could maintain the compression member under a slight compressive stress when the lid is in the fully opened position of 180° or more. This would insure that the lid remains open as the contents are dispensed from the container through the closure. Thus, as the container and closure are completely inverted during the pouring of the product from the container, the weight of the lid will not cause it to swing away from the fully open position. Further, if the user accidentally brushes against or bumps the fully opened lid, the lid will be held in the fully open position by the compressive stress in the compression member, or at least the lid will be less likely to be forced past the over-center point into the fully closed position.

The present invention provides an improved closure which can accommodate designs having the above-discussed benefits and features.

SUMMARY OF THE INVENTION

According to the present invention, a dispensing closure is provided for use on a container which has an opening communicating with the container interior. The closure includes a body for being mounted to the container over the container opening. The closure body defines a dispensing orifice for communicating through the container opening with the container interior. The body defines a pair of spaced-apart bearing cavities, and the body defines a rear abutment wall.

The closure includes a lid which has a pair of trunnions for each being received in one of the bearing cavities. The trunnions define an axis of rotation about which the lid can be pivoted through a range of movement between a fully closed position occluding the dispensing orifice and a fully opened position spaced away from the dispensing orifice.

A compression member extends from the lid toward the rear abutment wall. The compression member has a distal first end adapted to be moved into engagement with the rear abutment wall and has a second end pivotally connected to the lid at a location spaced from the trunnion axis. The compression member and lid are preferably molded as a unitary structure from a thermoplastic material, and the second end of the compression member is pivotally connected to the lid with a flexible film hinge along the hinge pivot axis.

The compression member has a length such that the compression member distal first end is spaced from the body rear abutment wall when the lid is in the fully closed position. However, the compression member distal first end engages the rear abutment wall of the body when the lid is pivoted away from the fully closed position. The compression member is subjected to a maximum stress when the lid is at an over-center point between the fully opened and fully closed positions.

The body bearing cavities are larger than the lid trunnions, and the bearing cavities are located relative to the rear abutment wall so as to provide clearance at least on opposite sides of each of the trunnions when the lid is in the fully closed position wherein the compression member is substantially unstressed. However, there is engagement between one side of each trunnion and one of the bearing cavities when the lid is in the fully open position so that the compression member is subjected to a relatively small amount of compressive stress.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in the normal (upright) operating position, and terms such as upper, lower, horizontal, etc., are used with reference to this position. It will be understood, however, that the closure of this invention may be manufactured, stored, transported, used, and sold in an orientation other than the position described.

Figures illustrating the closure show some structural features that are known and that will be recognized by one skilled in the art. The detailed descriptions of such features are not necessary to an understanding of the invention, and accordingly, are herein presented only to the degree necessary to facilitate an understanding of the novel features of the present invention.

With reference now to the figures, a first embodiment of the closure of the present invention is represented generally by the numeral 10. The closure 10 is adapted to be disposed on a container (not illustrated), such as a container which has a conventional mouth or opening defined by a neck or other suitable structure. The closure 10 is preferably fabricated from a thermoplastic material or other suitable material compatible with the container contents.

As illustrated in FIGS. 4–8, the closure 10 includes a body 20 for placement on the container. In the illustrated embodiment, the body 20 includes a peripheral wall in the form of an oval skirt or peripheral side wall 24.

Figure 7:
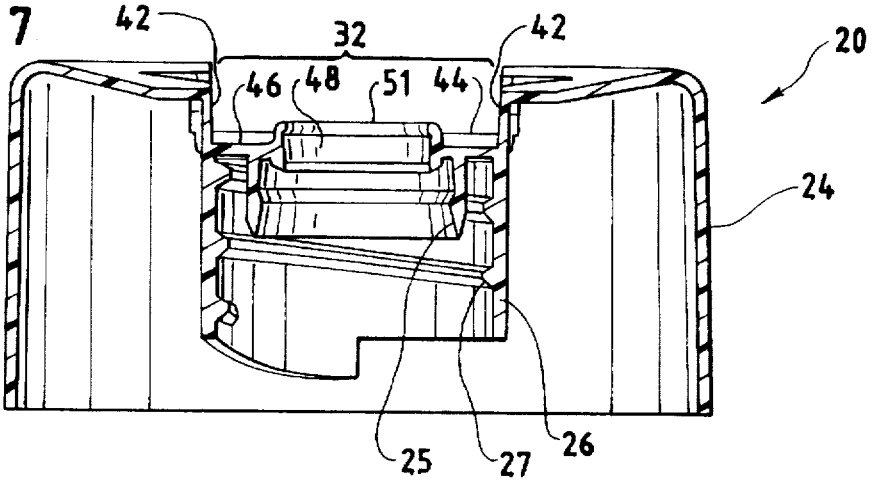
FIG. 7 is a cross-sectional view taken generally along the plane 7—7 in FIG. 6.
Figure 8:
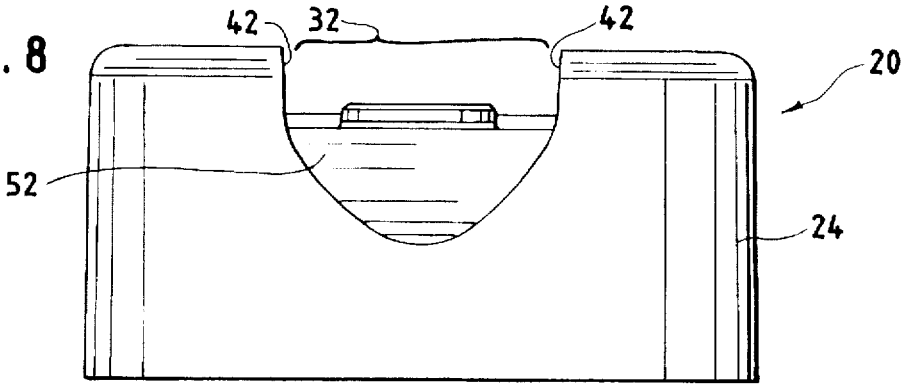
FIG. 8 is a front elevational view of the closure taken along the plane 8—8 in FIG. 6.

As illustrated in FIG. 7, the body 20 includes an internal sealing ring 25 which functions as a seal and protrudes into the interior of the container neck for engaging the inner peripheral surface of the neck so as to effect a tight seal.

Further, as illustrated in FIG. 7, the closure also includes an internal mounting wall or walls 26 defining a suitable engaging means such as a conventional thread 27 or snap-fit bead (not illustrated) for engaging suitable cooperating means (e.g., thread or snap-fit bead) on the container neck to releasably secure the body 20 to the container.

Figure 1:
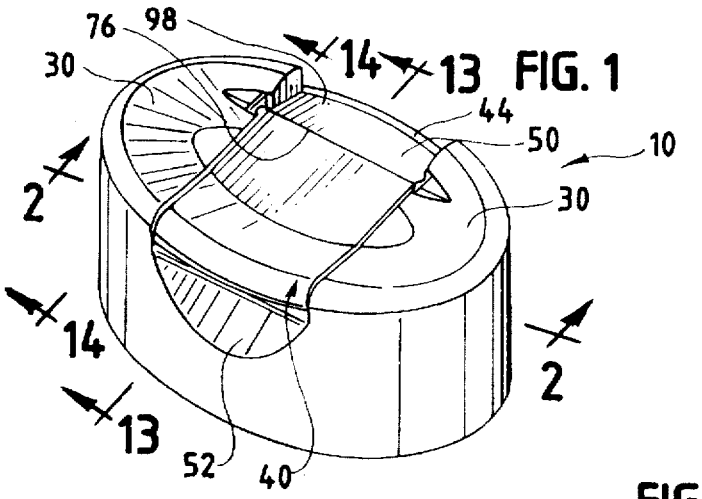
FIG. 1 is a perspective view of a first embodiment of the closure of the present invention shown when the lid is in the fully closed position.
Figure 2:
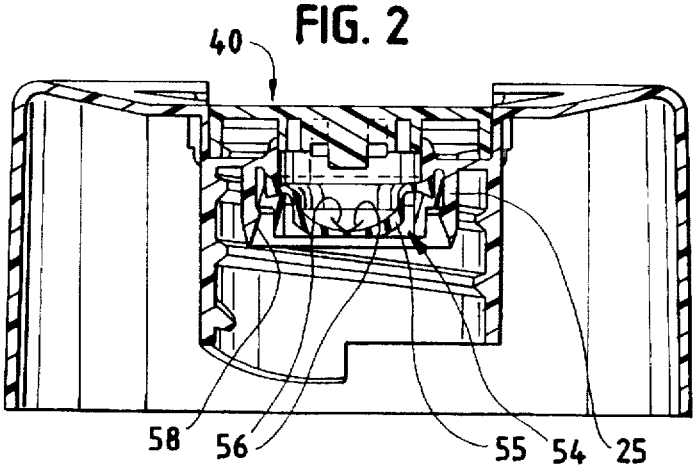
FIG. 2 is a greatly enlarged, cross-sectional view taken generally along the plane 2—2 in FIG. 1.
Figure 4:
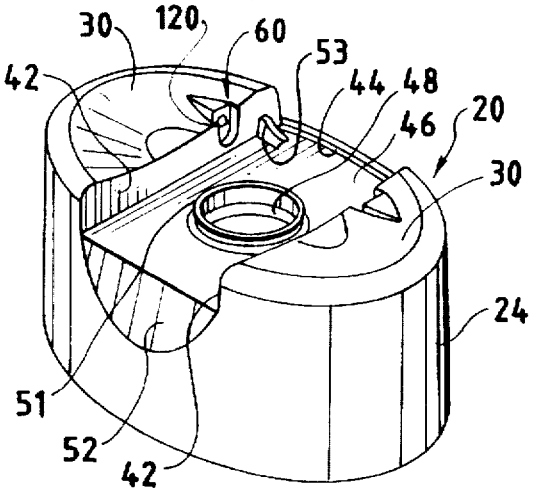
FIG. 4 is a view similar to FIG. 1, but FIG. 4 shows the closure body with the lid removed therefrom.
Figure 5:
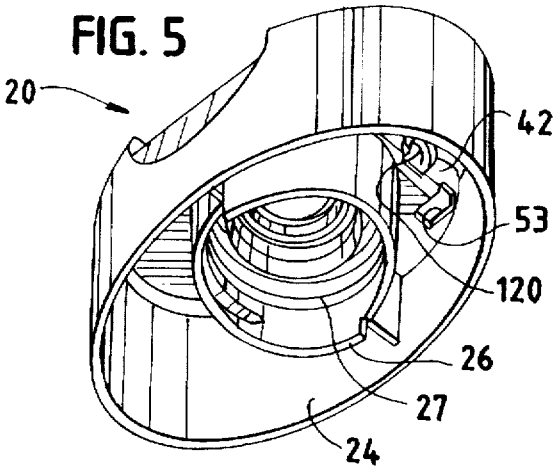
FIG. 5 is a bottom perspective view of the closure body shown in FIG. 4.
Figure 6:
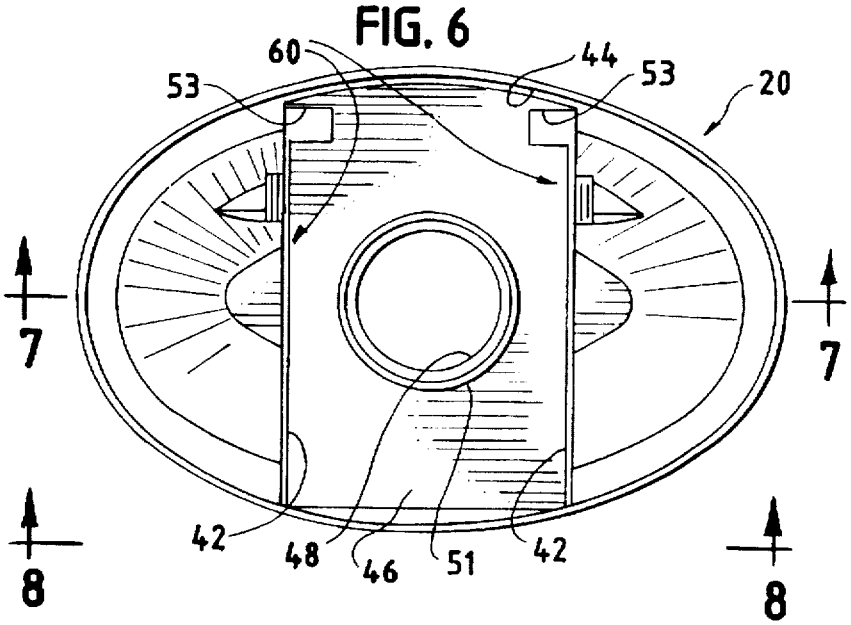
FIG. 6 is a top plan view of the closure body shown in FIG. 5.

As illustrated in FIG. 4, the closure body 20 includes a deck or transverse top wall 30. The top wall 30 is divided in two portions by a recess 32 (FIG. 7). The recess 32 receives a lid 40 (FIGS. 9–12) and an extending compression member 50 (FIGS. 9–12) when the lid 40 is installed on the closure body 20 as shown in FIGS. 1 and 2. As shown in FIGS. 4, 6, and 7, the recess 32 is more specifically defined by a pair of opposed side support walls 42, an arcuate rear abutment wall 44, and a generally horizontal, planar, bottom wall 46.

As illustrated in FIGS. 4 and 7, the bottom wall 46 defines a dispensing aperture 48. A cylindrical collar or spout 51 projects upwardly from the wall 46 around the dispensing aperture 48. At the front of the closure 10, the body skirt 24 has a recessed region 52 (FIGS. 1 and 4) for accommodating a thumb when opening the lid 40 by pushing the front edge of the lid 40 upwardly with the thumb.

Figure 3:
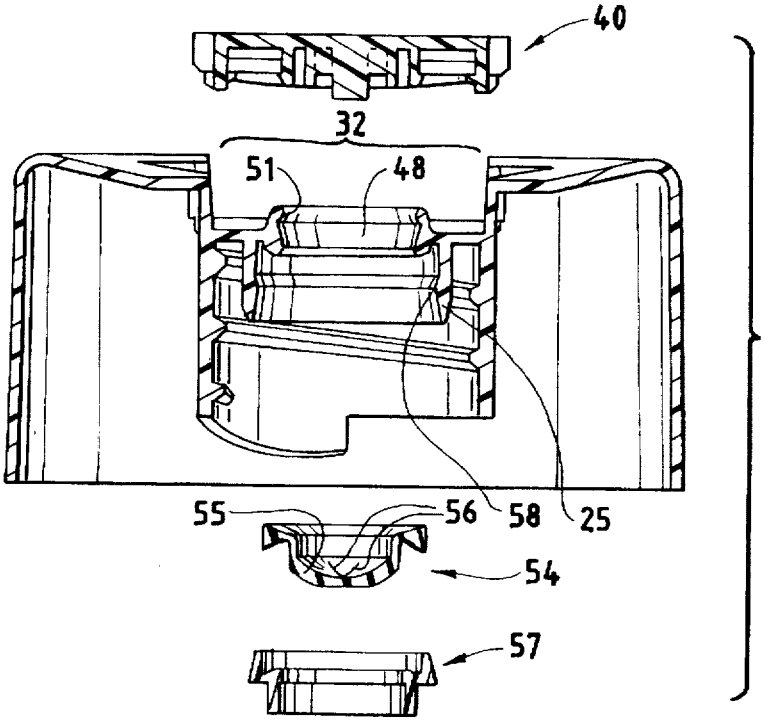
FIG. 3 is a cross-sectional view similar to FIG. 2, but FIG. 3 shows the components exploded.

The closure 10 may be optionally provided with a dispensing valve, such as a conventional, pressureopenable valve 54 (FIGS. 2, 3, and 13) having a central membrane 55 and two, mutually perpendicular, intersecting slits 56. When the valve 54 is in the normal, unactuated, rest position illustrated in FIG. 13, the central membrane 55 is at a first location spaced inwardly of the dispensing aperture 48 and has a concave configuration in which the slits 56 are closed.

If the container body is squeezed, then the pressure within the container is increased. If the container pressure is increased sufficiently, the membrane 55 is deflected outwardly to a second location closer to the dispensing aperture 48, and the slits 56 open. More specifically sector shaped flaps defined between the slits 56 open to permit the fluid product within the container body to be dispensed.

The above-described pressure openable valve may be of any suitable type, such as the conventional pressure-openable valve described in detail in the U.S. Pat. No. 5,531,363 wherein such a valve is identified by the reference numeral 70 and is illustrated in that patent in FIGS. 5–8. The description of the valve set forth in the U.S. Pat. No. 5,531,363 is incorporated herein by reference thereto to the extent not inconsistent herewith.

Figure 13:
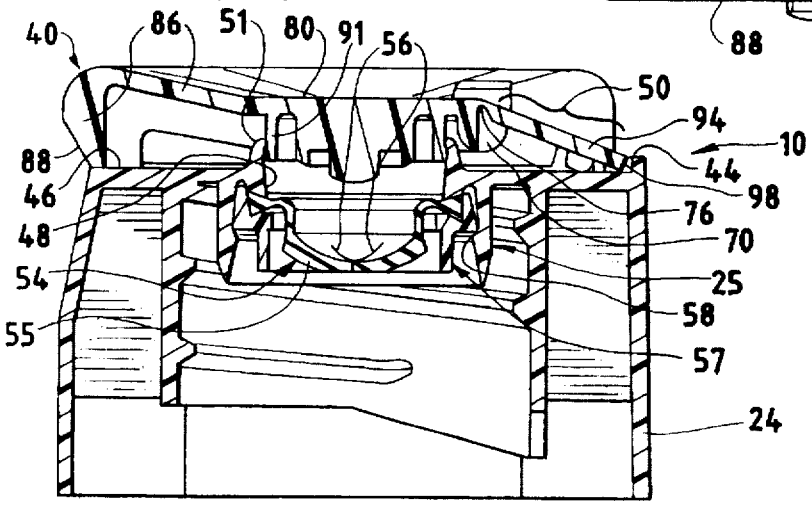
FIG. 13 is an enlarged, cross-sectional view taken generally along the plane 13—13 in FIG. 1.

The valve 54 is retained against the bottom of the spout 51 and within the internal sealing ring 25 by means of a retention ring 57 (FIG. 3) which is snap-fit past an annular bead 58 on the inside of the sealing ring 25 (FIGS. 2 and 13). The detailed structure of such a valve 54 and of such a valve retention structure forms no part of the present invention. Indeed, the closure of the present invention need not be provided with any such valve at all.

As shown in FIGS. 4, 5, and 14–18, the closure body support walls 42 each define an opening 53 adjacent the rear abutment wall 44. Each opening 53 also extends into the adjacent bottom wall 46. Each opening 53 is adapted to receive a tab on the compression member 50 as described in detail hereinafter.

Each support wall 42 also defines a pair of spaced-apart bearing cavities 60 (FIG. 6) for receiving a pair of trunnions 70 carried by, and projecting laterally from either side of, the lid 40.

Figure 9:
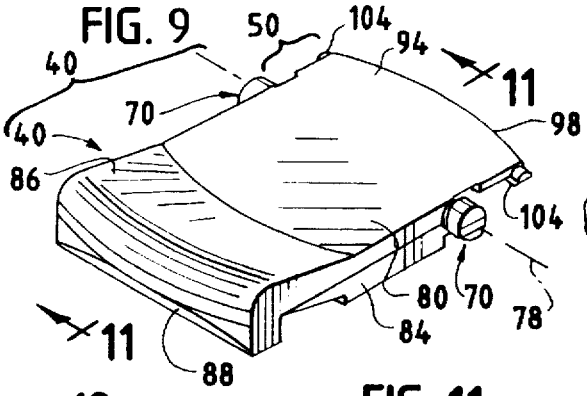
FIG. 9 is a top perspective view of the lid and compression member.
Figure 10:
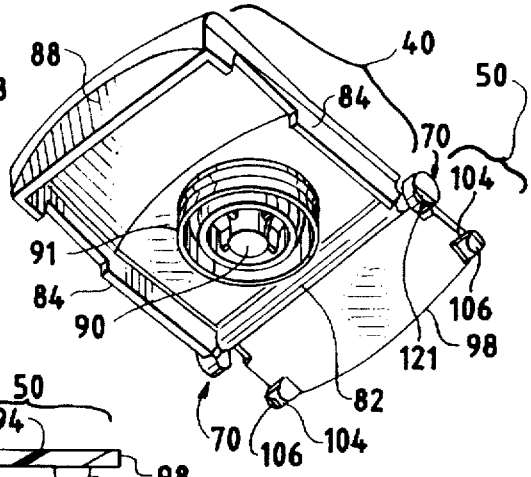
FIG. 10 is a bottom perspective view of the lid and compression member shown in FIG. 9.
Figure 11:
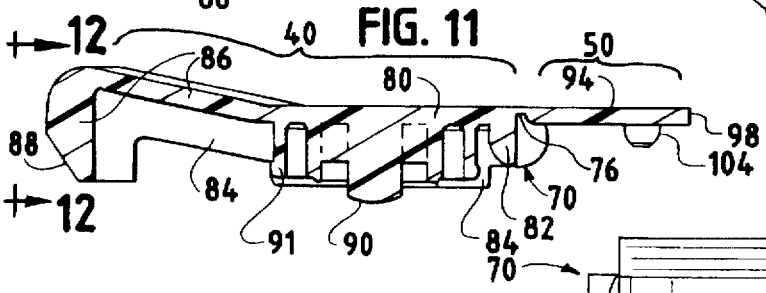
FIG. 11 is an enlarged cross-sectional view taken generally along the plane 11—11 in FIG. 9.
Figure 12:
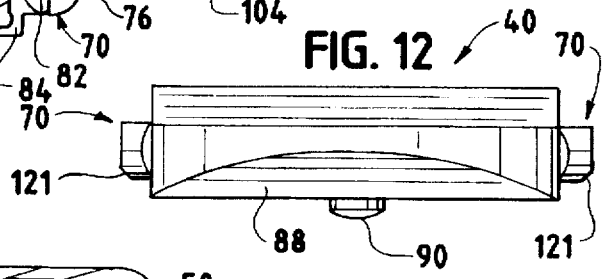
FIG. 12 is a front elevational view taken generally along the plane 12—12 in FIG. 11.
Figure 14:
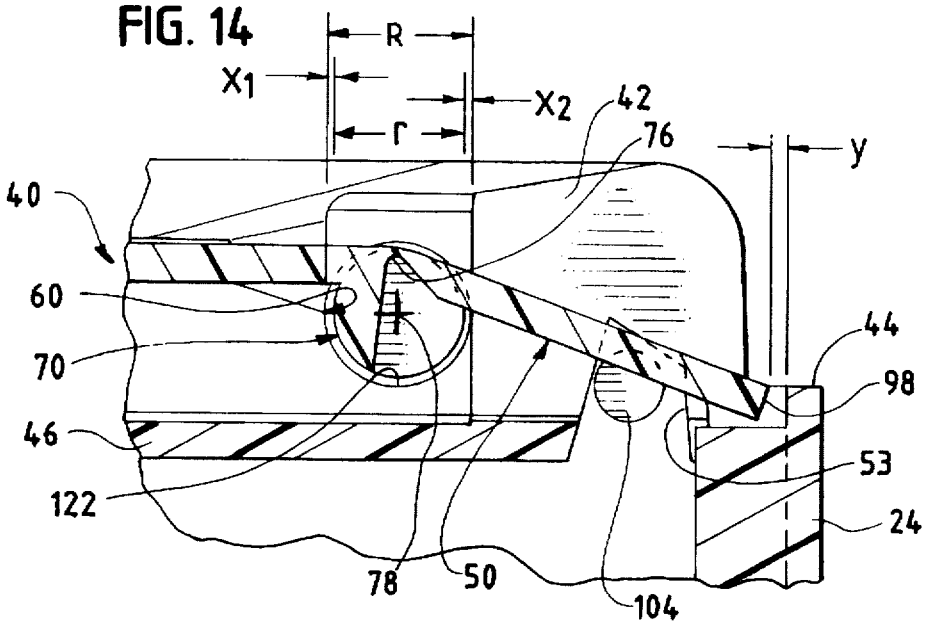
FIG. 14 is an enlarged, fragmentary, cross-sectional view taken generally along the plane 14—14 in FIG. 1.

The trunnions 70 are disposed at one end of the lid 40 adjacent a flexible film hinge 76 (FIGS. 1 and 11) which connects the lid 40 to the compression member 50 and which accommodates pivoting movement of the lid 40 and trunnions 70 about an axis 78 (FIGS. 9 and 14). The axis 78 is defined by the trunnions 70 directly below the closed position of the film hinge 76.

The lid 40 includes a generally planar, central, top wall 80 (FIG. 9), a rear wall 82 (FIGS. 10 and 11), two spaced-apart side walls 84 (FIG. 10), and a front wall 86 (FIGS. 9 and 11) having an inwardly slanting, projecting thumb lift portion 88. A generally cylindrical spud or plug 90 and annular ring 91 project from the lid top wall 80 for being received in the collar 51 when the lid 40 is closed to occlude the dispensing orifice 48. The lid side walls 84, rear wall 82, and front wall 86 are received within the recess 32 of the closure body 20. The bottom end of the front wall 86 abuts the top of the closure body wall 46 when the lid 40 is in the fully closed position as illustrated in FIG. 13.

The compression member 50 defines a planar top surface 94 which merges with the film hinge 76 (FIG.13). When the lid 40 is in the fully closed position (FIG. 13), the compression member 50 is angled generally downwardly from the upper surface of the lid top wall 80. The plane defining the compression member top surface 94 is tangent to the exterior cylindrical surface of each of the trunnions 70. The top surface of the lid top wall 80 and the top surface of the film hinge 76 are also each tangent to each of the trunnions 70.

The compression member 50 also has a laterally extending tab 104 (FIGS. 9–11 and 14–18) on each side for being received in one of the openings 53 in the adjacent closure body support wall 42 when the lid 40 is mounted in the closure body 20. Each tab 104 has an angled cam surface 106 (FIG. 10) to permit the tab 104 to be snap-fit into the opening 53. This engagement retains the compression member in the recess 32 of the closure body 20.

As illustrated in FIGS. 1, 9, 10, 12 and 13, the compression member 50 has an arcuate distal end 98 which is spaced a distance Y (FIG. 14) from the closure body abutment wall 44 when the lid 40 is closed (FIGS. 1 and 13).

The novel structure of the trunnions 70 and bearing cavities 60 accommodates a desired interaction of the components during the opening and closing of the lid 40. Specifically, each bearing cavity 60 (FIGS. 4 and 6) opens upwardly from each support wall 42 through the horizontal top wall 30 of the closure body 20 for receiving a trunnion 70. Each support wall 42 also defines an aperture 120 (FIGS. 4 and 5) outwardly of, but in communication with, the cavity 60. The aperture 120 receives the distal end portion of a trunnion 70. The closure body support walls 42 are each sufficiently resilient adjacent the aperture 120 so that the distal end portion of one of the trunnions 70 can be snapped through the aperture 120 as the trunnion 70 is seated in the bearing cavity 60. Each trunnion 70 has a slanted cam surface 121 (FIGS. 10 and 12) to facilitate assembly.

Preferably, as shown in FIG. 14, each bearing cavity 60 is defined by a bearing surface 122 which preferably has a partially cylindrical configuration. The bearing cavity 60 thus has a circular arc front surface portion facing generally toward the rear abutment wall 44 and has a circular arc rear portion facing generally away from the rear abutment wall 44. The two oppositely facing arcuate portions of the bearing surface 122 merge at the bottom of the cavity 60 and together define the complete bearing surface 122. As shown in FIG. 14, the diameter R of the partially cylindrical configuration of the bearing surface 122 is greater than the diameter r of the trunnion 70 received therein.

When the closure lid 40 is in the closed position, the trunnions 70 are disposed within the bearing cavities 60 (FIGS. 1 and 14) with a clearance $X_1$ on the front side of each trunnion 70 and with a clearance $X_2$ on the rear side of each trunnion 70. The compression member distal end 98 is spaced a distance Y (FIG. 14) from the rear abutment wall 44. Thus, the compression member 50 is substantially unstressed so long as the lid 40 is in the fully closed position. Since the closure 10 is usually fully closed, and is only temporarily in an open position, the compression member 50 is substantially unstressed during most of the life of the closure 10.

The substantial elimination of stresses on the compression member 50 when the lid 40 is in the fully closed position is achieved with the novel configuration of the link member 50, trunnions 70, and bearing cavities 60. In the preferred configuration, as illustrated in FIG. 14, the length of the compression member 50 is selected so when the lid 40 is in the fully closed position with the clearance $X_1$ on the front side of each trunnion 70 and the clearance $X_2$ on the rear side of each trunnion 70, the magnitude of the clearance of $X_1$ is substantially equal to the magnitude of the clearance $X_2$.

Figure 15:
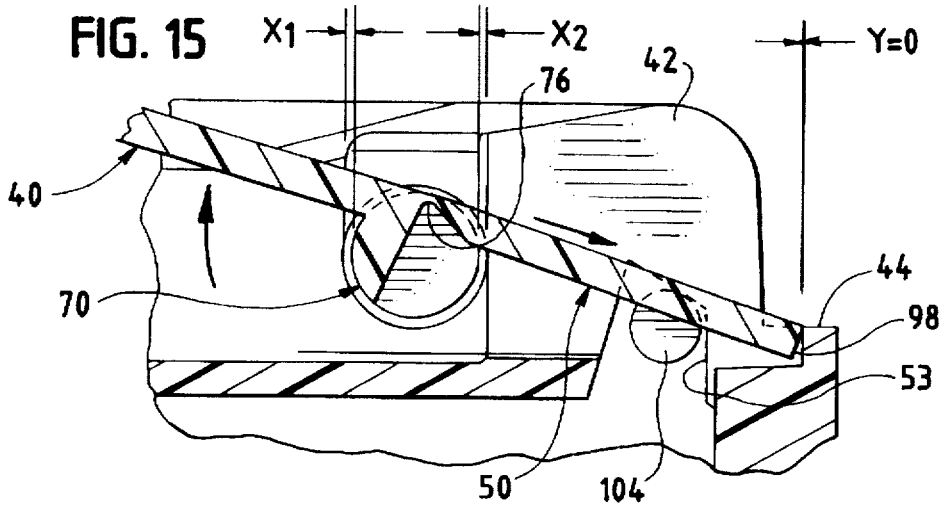
FIGS. 15, 16, 17, 18 and 19 are views similar to FIG. 14 and show, along with FIG. 14, the sequence of operation of the closure as the lid is pivoted from the fully closed position shown in FIG. 14 to the fully open position shown in FIG. 19.
Figure 16:
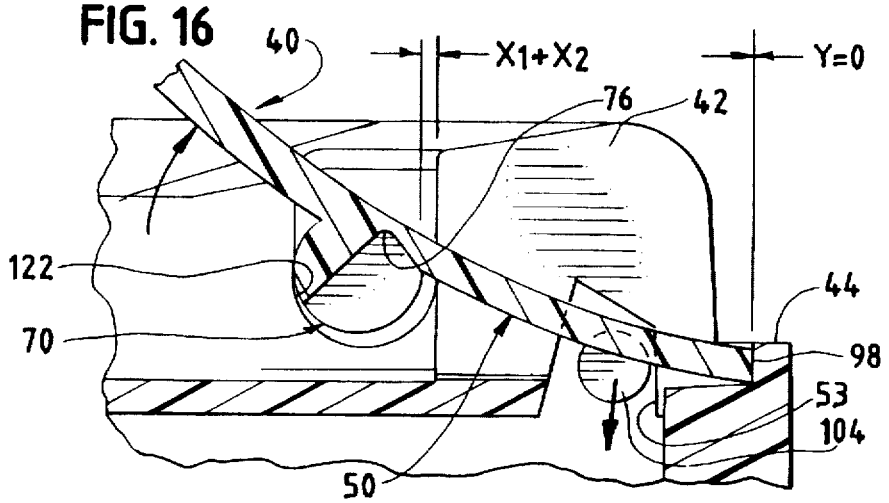
Figure 19:
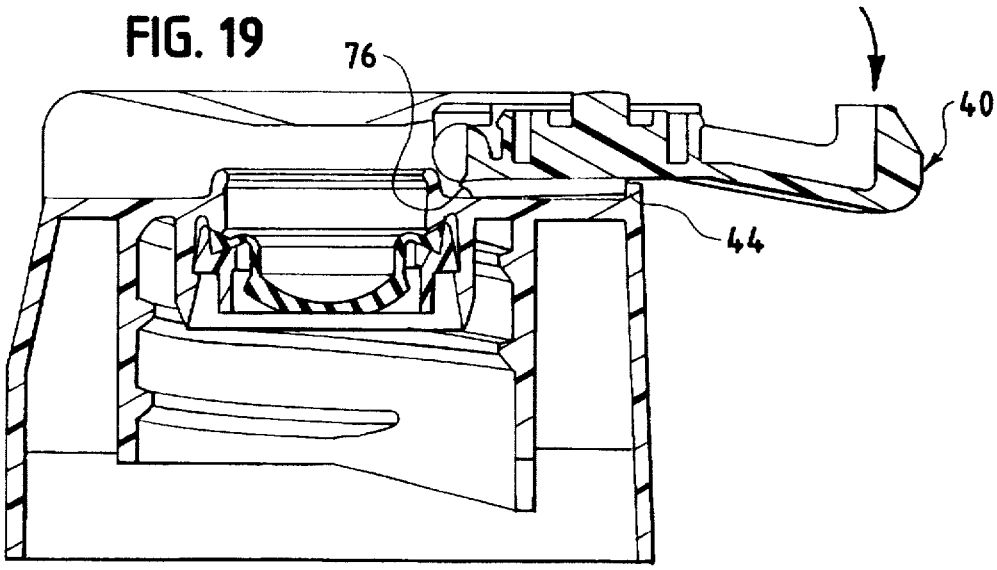
Figure 20:
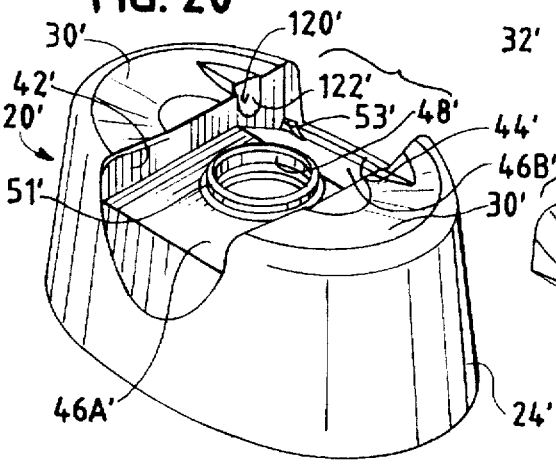
FIG. 20 is a perspective view of a body of a second embodiment of the closure of the present invention.

When the lid 40 is moved from the fully closed position (FIG. 14) toward the fully open position (FIG. 19), the trunnions 70 rotate in the bearing cavities 60, and the film hinge 76 is carried toward the rear abutment wall 44 (compare FIGS. 14, 15, and 16). This causes the compression member 50 to move rearwardly until the distal end 98 engages the rear abutment wall 44 (FIG. 15). As the lid 40 continues to be pivoted toward the fully open position, the compression member 50 deflects downwardly (FIG. 16), and the tabs 104 move downwardly. Also, the trunnions 70 move forwardly against the bearing cavity surface 122. The original clearance $X_1$ is thus eliminated at the front sides of the trunnions 70, and the clearance on the opposite, rear sides of the trunnions 70 increases by the clearance amount $X_1$ so as to provide a total clearance amount equal to the sum of the original front and rear clearances $X_1$ and $X_2$ (FIG. 16)

Figure 17:
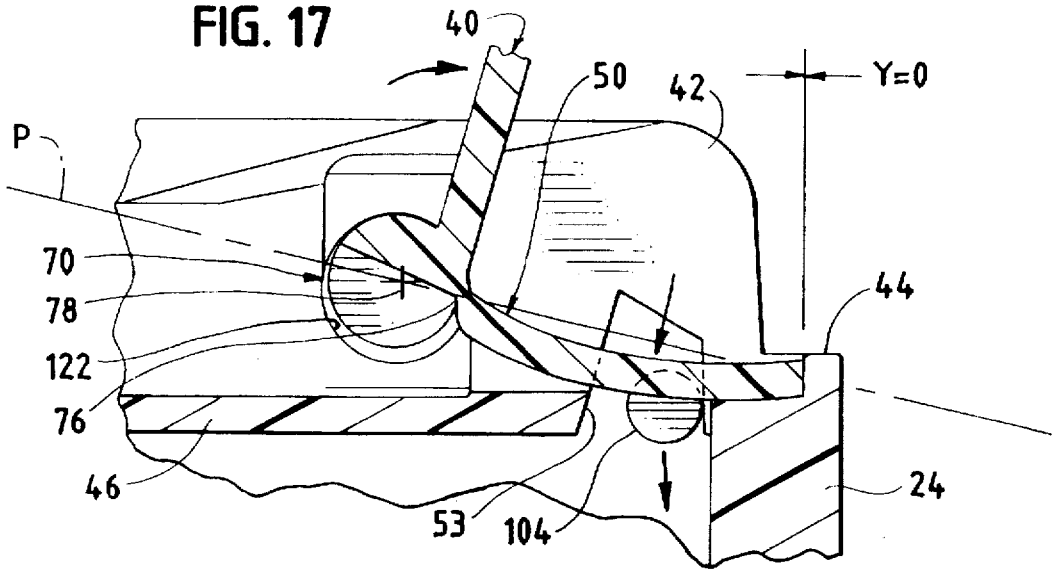
Figure 18:
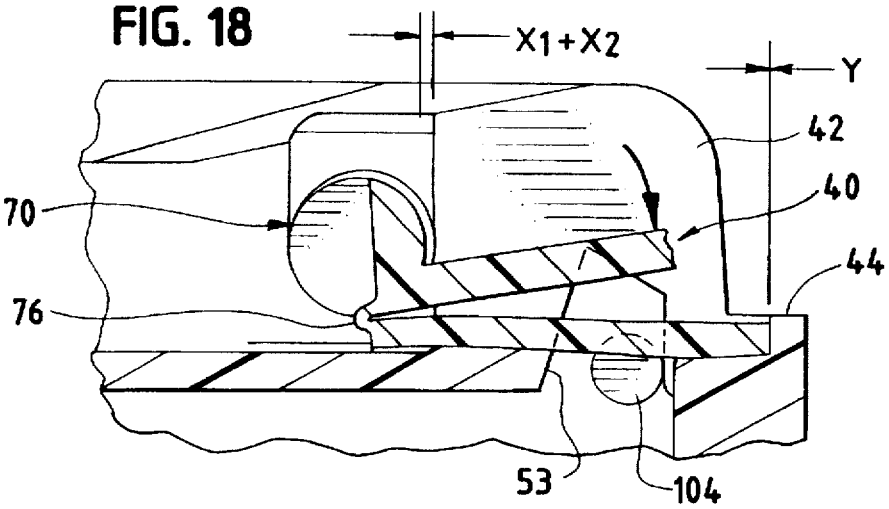

When the trunnions 70 have engaged the front sides of the bearing cavity surfaces 122 (FIG. 16), further rotation of the lid 40 toward the open position tends to move the front end of the compression member 50 (which is connected through film hinge 76 to the lid 40) further clockwise toward the over-center position shown in FIG. 17. This reduces the distance between the distal first end 98 of the member 50 and the second end of the member 50 at the lid film hinge 76. The reduction in the distance between the two ends of the member 50 results in compressive forces being imposed on the link member 50 which cause the member 50 to be deflected or bowed downwardly (FIGS. 16–18). The compression member 50 is maximally deformed at the over-center position shown in FIG. 17. In this portion the member 50 is subjected to maximum stress, and the second end of the compression member 50 which is attached at the film hinge 76 lies between, and generally on a plane defined by, the trunnion axis 78 and by the distal first end 98 of the member 50.

On either side of the over-center position (FIG. 17), deformation of the member 50 is at least partly reduced, and the lid 40 is thus urged to a stable position at the end of its travel range on one side of the over-center position. In this manner, when the lid 40 is closed, it is self-maintained in the stable closed position. On the other hand, when the lid 40 is opened just past the over center position shown in FIG. 17, the compression member 50 will cause the trunnion 70 and lid 40 to be rotated further beyond the over-center point (in the clockwise direction illustrated in FIG. 17), and this will carry the film hinge 76 further away from the body rear abutment wall 44 to thereby increase the distance and urge the lid 40 to the stable fully open position shown in FIG. 19.

In the fully open position, the stress on the member 50 is substantially reduced, and the member 50 returns to a substantially planar orientation. The distance between the film hinge 76 and the rear abutment wall 44 when the lid 40 is full open is slightly less than the distance between the film hinge 76 and the rear abutment wall 44 when the lid 40 is in the fully closed position. Thus, in the fully open position of the lid 40, there is some stress in the compression member 50 so as to hold the lid 40 open even at a 180° or more opening angle.

The novel structural configuration of the closure 10 of the present invention provides clearances around the trunnions in the fully closed positions which are sufficient to accommodate normal manufacturing or molding tolerances. Thus, if the trunnions 70 are made larger and/or smaller and or if the bearing cavities 60 are made slightly larger or smaller (within appropriate design tolerances), then the compression member 50 will still not be subjected to significant compressive stresses when the lid 40 is in the fully closed position.

Figure 22:
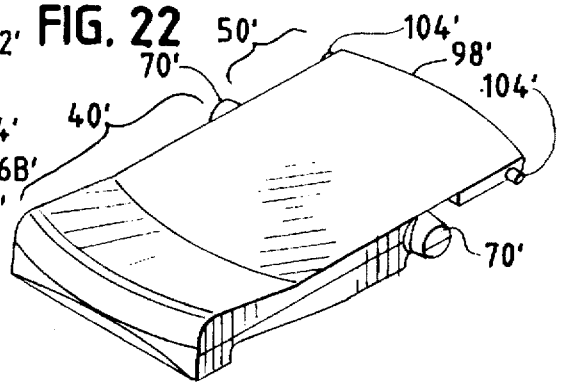
FIG. 22 is a top, perspective view of a closure lid and compression member which is adapted to be mounted to the top of the closure body illustrated in FIGS. 20 and 21.
Figure 21:
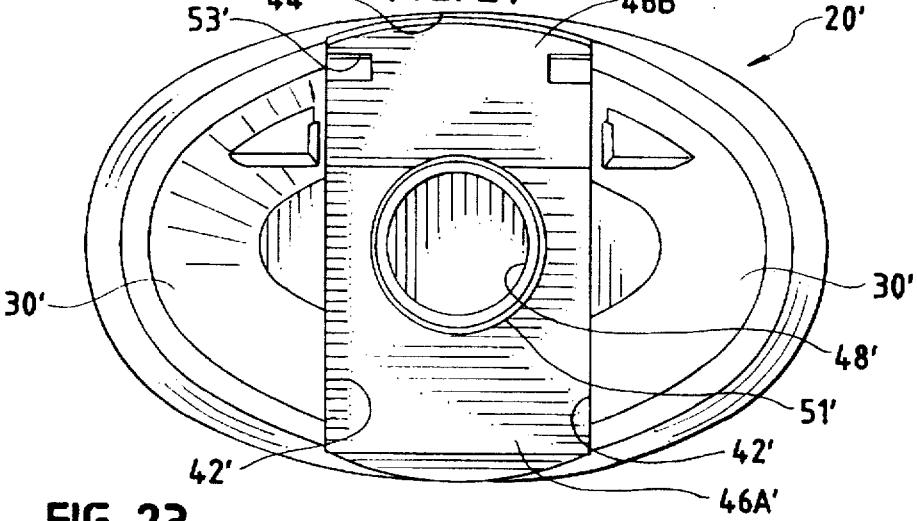
FIG. 21 is a top plan view of the closure body of the second embodiment illustrated in FIG. 20.
Figure 23:
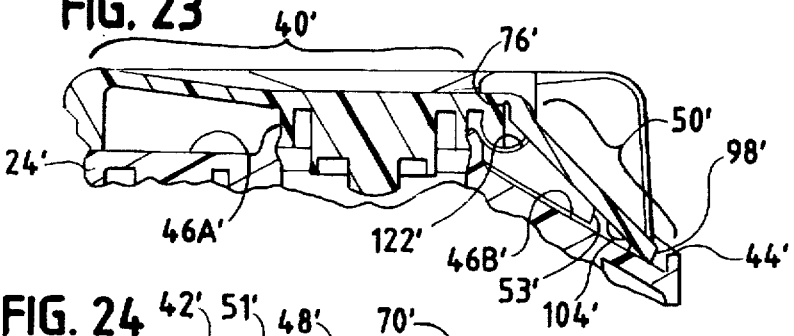
FIG. 23 is a fragmentary, cross-sectional view illustrating the lid shown in FIG. 22 mounted in a closed position on the closure body in FIGS. 20 and 21.
Figure 24:
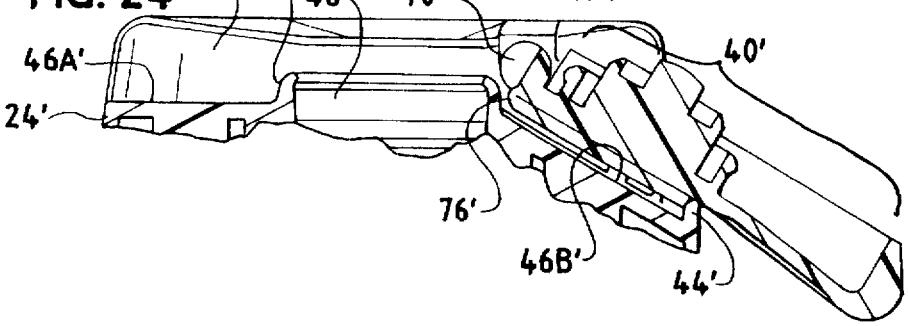
FIG. 24 is a view similar to FIG. 23, but FIG. 24 shows the lid in the fully open position.

A second embodiment of the closure of the present invention is illustrated in FIGS. 20–24 wherein the closure includes a closure body 20' having a skirt 24'. The closure body 20' includes a rear abutment wall 44' and also includes a top wall 30' from which depend a pair of opposed side support walls 42'. The walls 42' and 44' define a recess 32' for receiving a compression member 50' and lid 40' which are pivotally connected together with a film hinge 76' (FIGS. 23 and 24). A horizontal wall 46A' defines the bottom of the front portion recess 32', and includes a dispensing aperture 48' surrounded by a short collar or spout 51'.

The bottom of the rear portion of the recess 32'is defined by a downwardly angled wall 46B'. The side support walls 42' each define an aperture 120' communicating with a bearing cavity defined by a bearing surface 122'. Each support wall 42' also defines an opening 53' (FIGS. 20, 21, and 23) which extends into the adjacent angled bottom wall 46B'.

With the exception of the downwardly angled rear bottom wall portion 46B', the above-described structure of the body 20' of the closure of the second embodiment is substantially identical to the first embodiment body 20 described above with reference to FIGS. 1–19.

The compression member 50' has two, laterally extending trunnions 70' and two, laterally extending tabs 104' (FIGS. 22 and 23). The structure of the second embodiment lid 40' and compression member 50' is substantially the same as the structure of the first embodiment lid 40 and member 50 described above with reference to FIGS. 1–19.

The portion of the second embodiment closure body 20' adjacent the apertures 120' and openings 53' is sufficiently resilient so that the trunnions 70' and tabs 104' can be snapped into the apertures 120' and opening 53', respectively.

When the lid 40' is properly mounted in the recess 32' in the lower body 20', the compression member 50' is angled downwardly along the bottom wall 46B' as shown in FIG. 23. The member 50' has a distal end 98' which is spaced from the closure body rear abutment wall 44' when the lid 40' is closed (FIG. 23).

The second embodiment of the closure shown in FIGS. 20–24 employs clearances between the trunnion 70' and bearing surfaces 122' when the lid is closed in the same manner with the first embodiment trunnions 70 and bearing surfaces 122 described above with reference to FIGS. 1–19. The second embodiment operates in generally the same manner as does the first embodiment when the lid opens and closes. However, because the second embodiment has a downwardly angled closure body wall 46B', the lid 40' can be opened more than 180° as shown in FIG. 24.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure for use on a container defining an opening communicating with the container interior, said closure comprising:

a body for being mounted to said container over said container opening and defining a dispensing orifice for communicating through said container opening with said container interior, said body defining a pair of spaced-apart bearing cavities and defining a rear abutment wall;

a lid including a pair of trunnions for each being received in one of said bearing cavities and defining an axis of rotation about which said lid can be pivoted through a range of movement between a fully closed position occluding said dispensing orifice and a fully open position spaced away from said dispensing orifice;

a compression member extending from said lid toward said rear abutment wall, said compression member having a distal first end adapted to be moved into engagement with said abutment wall and having a second end pivotally connected to said lid at a location spaced from said trunnion axis, said compression member having a length such that said compression member distal first end is spaced from said body rear abutment wall when said lid is in said fully closed position but such that said distal first end is engaged with said rear abutment wall when said lid is pivoted away from said fully closed position; and said bearing cavities being larger than trunnions and located relative to said rear abutment wall so as to provide clearance at least on opposite sides of each said trunnion when said lid is in said fully closed position wherein said compression member is substantially unstressed.

2. The closure in accordance with claim 1 in which said trunnions are cylindrical;

said bearing cavities each have at least a circular arc front surface portion facing generally toward said abutment wall and a circular arc rear surface portion facing generally away from said abutment wall; and each said trunnion in one of said bearing cavities is spaced from said one bearing cavity front and rear surfaces when said lid is in said fully closed position.

3. The closure in accordance with claim 2 in which each said bearing cavity is defined in said body by a partially cylindrical surface extending around said trunnion axis;

said body defines an aperture adjacent said partially cylindrical surface of each said bearing cavity; and each said trunnion has a distal end portion adapted to extend into said aperture; and said body adjacent said aperture is sufficiently resilient so that each said trunnion distal end portion can be snapped into one of said apertures.

4. The closure in accordance with claim 1 in which said closure is formed from a thermoplastic material.

5. The closure in accordance with claim 4 in which said second end of said compression member is pivotally connected to said lid with a flexible film hinge.

6. The closure in accordance with claim 1 in which said body defines a recess for receiving said compression member distal first end; and said body rear abutment wall defines the rear periphery of said recess.

7. The closure in accordance with claim 1 in which said rear abutment wall has an arcuate configuration at the rear periphery of said body; and said compression member distal first end has an engaging surface with an arcuate configuration substantially corresponding to the arcuate configuration of said rear abutment wall.

8. The closure in accordance with claim 1 in which said closure body, lid, and compression member are formed from a thermoplastic material;

said compression member has a generally planar top surface;

said lid has a generally planar top surface;

each said trunnion is cylindrical and is substantially tangent to the planes of said top surfaces; and said second end of said compression member is pivotally connected to said lid with a flexible film hinge along a hinge pivot axis at said planar top surfaces.

9. The closure in accordance with claim 8 in which said axis of rotation defined by said cylindrical trunnions is parallel to said hinge pivot axis defined by said film hinge at said second end of said compression member.

10. The closure in accordance with claim 9 in which said body has spaced-apart parallel support walls adjacent said compression member;

said compression member is disposed between said support walls;

each said support wall defines an opening;

said compression member has two tabs projecting laterally in opposite directions, each said tab being received in one of said openings.

11. A dispensing closure for use on a container defining an opening communicating with the container interior, said closure comprising:

a body for being mounted to said container over said container opening and defining a dispensing orifice for communicating through said container opening with said container interior, said body defining a pair of spaced-apart bearing cavities and defining a rear abutment wall;

a lid including a pair of trunnions for each being received in one of said bearing cavities and defining an axis of rotation about which said lid can be pivoted through a range of movement between a fully closed position occluding said dispensing orifice and a fully open position spaced away from said dispensing orifice;

a compression member extending from said lid toward said rear abutment wall, said compression member having a distal first end adapted to be moved into engagement with said abutment wall and having a second end pivotally connected to said lid at a location spaced from said trunnion axis, said compression member having a length such that said compression member distal first end is spaced from said body rear abutment wall when said lid is in said fully closed position but such that said distal first end is engaged with said rear abutment wall when said lid is pivoted away from said fully closed position whereby said compression member is subjected to maximum stress when said lid is between said fully open and fully closed positions at an over center point at which said compression member second end lies between, and generally on a plane defined by, said trunnion axis and said compression member distal first end; and said bearing cavities being larger than said trunnions and located relative to said rear abutment wall so as to provide clearance at least on opposite sides of each said trunnion when said lid is in said fully closed position wherein said compression member is substantially unstressed and so as to provide engagement between one side of each said trunnion and one of said being cavities when said lid is in said fully open position wherein said compression link member is stressed.

12. The closure in accordance with claim 11 in which said closure body, lid, and compression member are formed from a thermoplastic material;

said compression member has a generally planar top surface;

said lid has a generally planar top surface; and said lid top surface is at an oblique angle relative to said compression member top surface when said lid is in said fully closed position.

13. The closure in accordance with claim 12 in which said closure body, lid, and compression member are formed from a thermoplastic material;

said body defines a recess for receiving said lid and compression member, said recess being defined in part by a bottom wall, by a pair of spaced-apart lateral support walls, and by said rear abutment wall.

14. The closure in accordance with claim 13 in which each said bearing cavity is defined in one of said support walls;

each said bearing cavity is open inwardly to said recess and is open upwardly for receiving one of said trunnions;

said support walls each define an aperture outwardly of one of said bearing cavities for receiving a distal end portion of one of said trunnions; and said body support walls are sufficiently resilient adjacent each said aperture so that each one of said trunnion distal end portions can be snapped into one of said apertures.

15. The closure in accordance with claim 13 in which each said support wall defines an opening; and said compression member has a laterally extending tab on each side received in one of said openings.

* * * * *